US010214843B2

(12) United States Patent
Kim

(10) Patent No.: US 10,214,843 B2
(45) Date of Patent: Feb. 26, 2019

(54) CONTROL METHOD OF WASHING MACHINE

(71) Applicant: LG ELECTRONICS INC., Seoul (KR)

(72) Inventor: Kyunghoon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 56 days.

(21) Appl. No.: 15/045,832

(22) Filed: Feb. 17, 2016

(65) Prior Publication Data

US 2016/0237610 A1 Aug. 18, 2016

(30) Foreign Application Priority Data

Feb. 17, 2015 (KR) ..... 10-2015-0024407

(51) Int. Cl.

*D06F 33/02* (2006.01)
*D06F 29/02* (2006.01)
*D06F 39/00* (2006.01)

(52) U.S. Cl.

CPC ..... *D06F 33/02* (2013.01); *D06F 29/02* (2013.01); *D06F 39/003* (2013.01);
(Continued)

(58) Field of Classification Search

None
See application file for complete search history.

(56) References Cited

U.S. PATENT DOCUMENTS 3,306,082 A * 2/1967 Eiichi ..... D06F 17/06 192/12 BA
5,606,877 A * 3/1997 Hashimoto ..... D06F 35/006 68/12.04

(Continued)

FOREIGN PATENT DOCUMENTS

EP 1 964 958 9/2008
JP H 10-57664 3/1998

(Continued)

OTHER PUBLICATIONS

Hashiba. Shuji, Drum-Type Washing Machine, JP20100063614A translation (Year: 2010).*

(Continued)

*Primary Examiner* — Jason Y Ko
*Assistant Examiner* — Cristi J Tate-Sims
(74) *Attorney, Agent, or Firm* — Ked & Associates, LLP

(57) ABSTRACT

A control method of a washing machine may include supplying water to a predetermined unbalance induction water level into a wash tub configured to accommodate fabric, the wash tub being rotated about a vertical axis, rotating a pulsator inside the wash tub, sensing an amount of fabric, rotating the wash tub at a constant acceleration, determining unbalance based on a current value applied to a motor in a state in which a rotational speed of the wash tub falls in a given range and the sensed amount of fabric while the wash tub is rotated at the constant acceleration, and supplying water to a first water supply level into the wash tub when the unbalance is greater than a reference value, and supplying water to a second water supply level, which is higher than the first water supply level, when the unbalance is smaller than the reference value.

15 Claims, 6 Drawing Sheets

(52) U.S. Cl.
CPC ..... *D06F 2202/10* (2013.01); *D06F 2202/12* (2013.01); *D06F 2204/08* (2013.01); *D06F 2204/086* (2013.01); *D06F 2222/00* (2013.01)

(56) References Cited

U.S. PATENT DOCUMENTS

| | | | | |
|---|---|---|---|---|
| 6,065,170 | A * | 5/2000 | Jang | D06F 37/203 68/12.04 |
| 6,163,912 | A * | 12/2000 | Matsuura | D06F 37/203 68/12.16 |
| 2004/0148709 | A1* | 8/2004 | Kim | D06F 39/003 8/158 |
| 2004/0154350 | A1* | 8/2004 | Weinmann | D06F 33/02 68/12.04 |
| 2006/0000029 | A1* | 1/2006 | Park | D06F 35/006 8/158 |
| 2006/0016021 | A1* | 1/2006 | Kim | D06F 35/006 8/158 |
| 2008/0120790 | A1 | 5/2008 | Ashrafzadeh et al. | |
| 2010/0139011 | A1 | 6/2010 | Kim et al. | |
| 2012/0005840 | A1 | 1/2012 | Jang et al. | |
| 2014/0082959 | A1* | 3/2014 | Oh | D06F 33/02 34/319 |
| 2015/0252510 | A1* | 9/2015 | Heo | D06F 37/203 8/137 |
| 2016/0076188 | A1* | 3/2016 | Vasickova | D06F 39/003 177/1 |

FOREIGN PATENT DOCUMENTS

| | | | |
|---|---|---|---|
| KR | 10-2011-0011460 | A | 2/2011 |
| KR | 10-2011-0023062 | A | 3/2011 |
| KR | 10-2012-0004272 | A | 1/2012 |
| KR | 10-2014-0045713 | A | 4/2014 |

OTHER PUBLICATIONS

Korean Notice Allowance issued in Application No. 10-2015-0024407 dated Mar. 2, 2016.
Euopean Search Report dated Jul. 27, 2016 issued in Application No. 16 15 6071.9.

* cited by examiner

CONTROL METHOD OF WASHING MACHINE

CROSS-REFERENCE TO RELATED APPLICATION

This application claims the priority benefit of Korean Patent Application No. 10-2015-0024407, filed on Feb. 17, 2015 in the Korean Intellectual Property Office, the disclosure of which is incorporated herein by reference.

BACKGROUND

1. Field

The present disclosure relates to a control method of a washing machine.

2. Background

In general, a washing machine is an apparatus that removes contaminants adhered to laundry via several operations including, for example, washing, dehydration and/or drying. In the washing machine, a wash tub, in which laundry such as, for example, clothing or bedding (hereinafter referred to as "fabric") is accommodated, is rotated in a water storage tub, so as to remove contaminants adhered to the fabric. The washing machine performs the supply of water into the water storage tub, washing or rinsing to remove contaminants adhered to fabric via rotation of the wash tub, drainage of the water from the water storage tub, and dehydration of the fabric via high-speed rotation of the wash tub in sequence. However, in the case of unbalanced rotation in which the wash tub is rotated in the state in which the fabric is collected on one side inside the wash tub, collision between the wash tub and the water storage tub may occur due to excessive vibration.

In the related art, after the water inside the water storage tub is drained, the extent of unbalance of the wash tub (hereinafter referred to as "unbalance") may be sensed by rotating the wash tub at a constant speed. When the unbalance is lower than a predetermined tolerance value, the wash tub is accelerated to a higher speed so as to perform dehydration. Judging that fabric has collected on one side inside the wash tub or that multiple pieces of fabric agglomerate together, the wash tub may be alternately rotated in opposite directions so as to disperse the fabric, and thereafter the detection of unbalance may be repeated.

Under ordinary circumstances, the fabric may be evenly dispersed inside the wash tub as the dispersion of fabric is repeated several times, and dehydration may be performed once the unbalance of the wash tub has been reduced. However, depending on the state of the fabric introduced into the wash tub, the unbalance of the wash tub may not be easily reduced even when the dispersion of fabric is repeated. Therefore, the time taken to begin dehydration may be excessively increased, attributable to the repeated dispersion of fabric, or in severe cases, the washing machine may fail to perform dehydration.

Recently, washing machines that provide a specific course suitable for washing fabric having a large length, area or volume (e.g. bed sheets, towels, blankets, and bed clothes) have been introduced. However, the previous describe course is performed regardless of a characteristic of fabric introduced into the wash tub, and may not eliminate the unbalance of the wash tub even when the dispersion of fabric is attempted. For example, the elimination of unbalance may be difficult when respective pieces of fabric are large, e.g., two or more quilts, two or more towels or bed sheets.

BRIEF DESCRIPTION OF THE DRAWINGS

The embodiments will be described in detail with reference to the following drawings in which like reference numerals refer to like elements and wherein.

DETAILED DESCRIPTION

Figure 1:
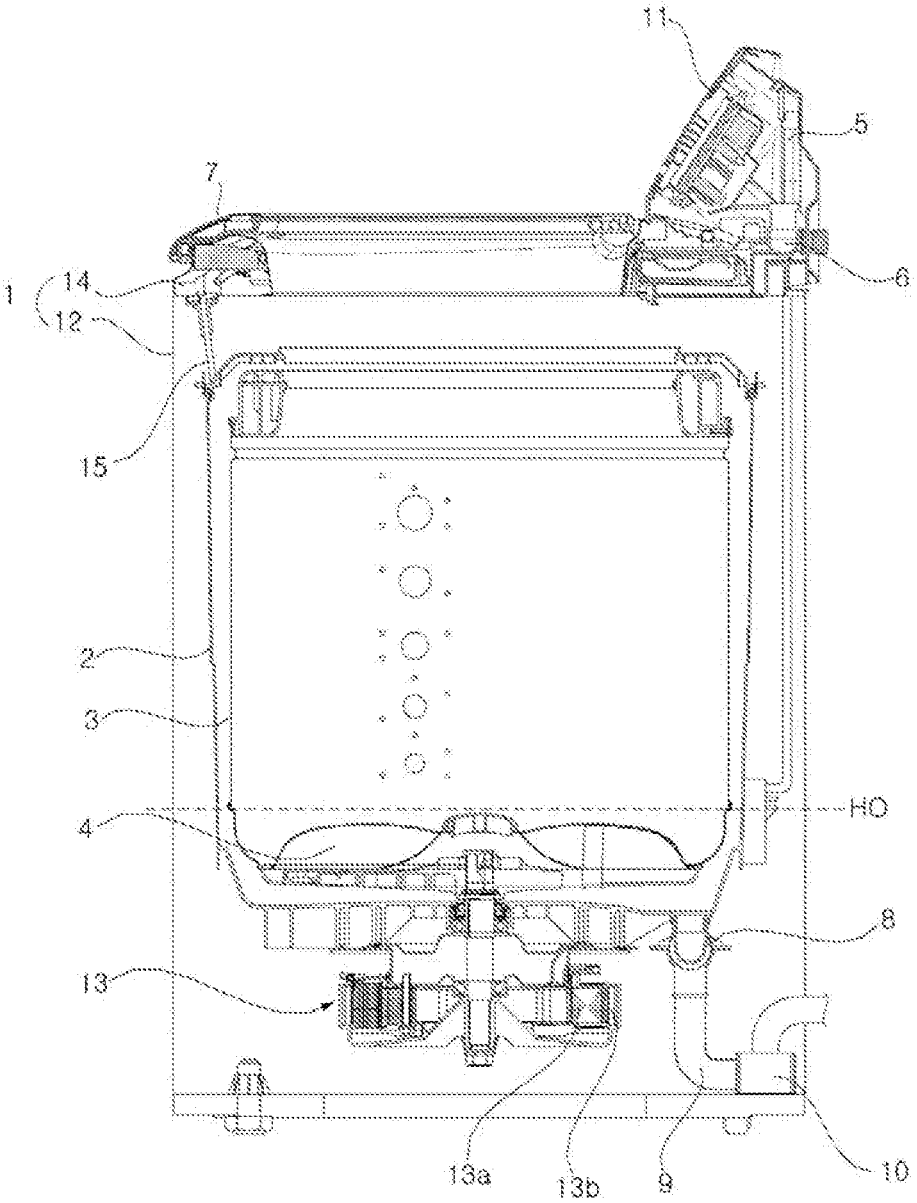
FIG. 1 is a side sectional view of a washing machine in accordance with one embodiment.
Figure 2:
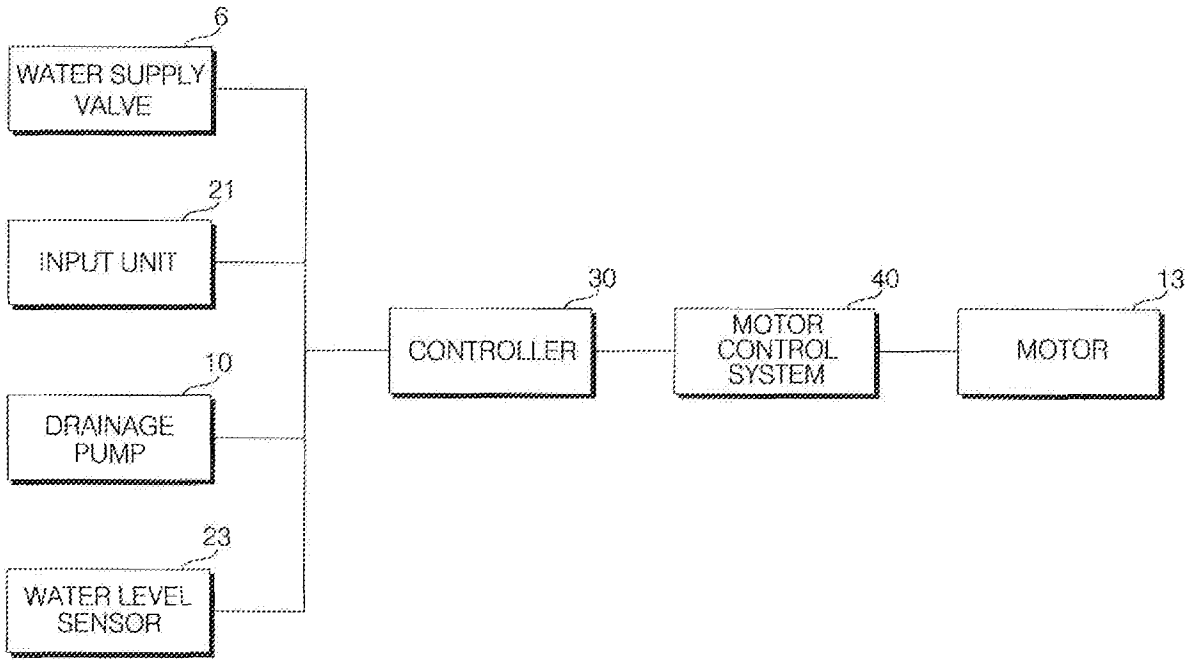
FIG. 2 is a block diagram illustrating the control relationship between major components of the washing machine illustrated in FIG. 1.

Referring to FIGS. 1 and 2, the washing machine in accordance with one embodiment may include a casing 1, a water storage tub 2, which may be placed inside the casing 1 and may be configured to accommodate wash water therein, a wash tub 3, which may be configured to accommodate laundry therein and may be rotatably provided inside the water storage tub 2, a pulsator 4, which may be rotatably provided inside the wash tub 3, and a motor 13, which may rotate the wash tub 3 and/or the pulsator 4.

A clutch may be provided to control a torque transmitted from the motor 13 to the wash tub 3 or the pulsator 4. As the clutch is appropriately operated under the control of a controller 30, only the pulsator 4 may be rotated in the state in which the wash tub 3 remains stationary, or both the pulsator 4 and the wash tub 3 may be rotated.

The casing 1 may internally provide a space in which various constituent elements of the washing machine such as, for example, the water storage tub 2, the wash tub 3 and the motor 13 may be accommodated. The casing 1 may include a cabinet 12 and a cabinet cover 14. The cabinet 12 may be open at the top thereof and provide an internal space in which the water storage tub 2 is accommodated. The cabinet cover 14 may be disposed on the open top of the cabinet 12 and may be provided at the approximate center thereof with an opening for the introduction and discharge of laundry. A door 7 may be rotatably provided on the cabinet cover 14 and is configured to open or close the opening.

The water storage tub 2 may be open at the top thereof, and may suspended from the casing 1 by a support member 15. The upper end of the support member 15 may be rotatably connected to the cabinet cover 14, and the lower end of the support member 15 may be connected to the lower end of the water storage tub 2 by a suspension. The suspension may serve to dampen vibration of the water storage tub 2 caused when the wash tub 3 or the pulsator 4 is rotated.

The top of the wash tub 3 may be open to allow fabric to be introduced from the upper side, and the wash tub 3 may be rotated about the vertical axis. The pulsator 4 may be provided on the bottom of the wash tub 3. A plurality of through-holes may be formed in the wash tub 3 to enable the flow of wash water between the wash tub 3 and the water storage tub 2.

The casing 1 may be provided with a control panel 11. The control panel 11 may include an input unit (or an input interface) 21, which receives various control commands related to the general operation of the washing machine from the user, and a display unit (or display), which displays the operational state of the washing machine. The input unit 21 may include various operating buttons, dials, and touch-screen, for receiving the control commands. The display unit may include, for example, diodes or an LCD/LED panel, and may take the form of a touchscreen that has the function of the input unit 21.

A water supply flow path 5 may be connected to a water source such as, for example, a water tap, and a water supply valve 6 may be provided on the water supply flow path 5 so as to control the supply of water. When the water supply valve 6 is opened by the controller 30, the water guided through the water supply flow path 5 may be supplied into the wash tub 3 and/or the water storage tub 2. In some embodiments, the water guided through the water supply flow path 5 may not be directly supplied to the wash tub 3, but may be supplied through any passage between the water storage tub 2 and the wash tub 3, and even in this case, the water may be introduced into the wash tub 3 from the water storage tub 2 through the holes formed in the wash tub 3, and therefore the level of water may be the same in the water storage tub 2 and the wash tub 3 when the supply of water is completed.

The washing machine may further include a drainage flow path 9 through which the water discharged from the water storage tub 2 is guided, a drainage valve 8 configured to control the drainage flow path 9, and a drainage pump 10 provided on the drainage flow path 9. The drainage valve 8 may be opened under the control of the controller 30, and the water may be discharged from the water storage tub 2 when the drainage pump 10 is operated. The motor 13 may include a stator 13*a*, around which a coil is wound, and a rotor 13*b*, which may be rotated via electromagnetic interaction with the coil. In the embodiment, the stator 13*a* of the motor 13 may be an armature that receives current through the coil, and the rotor 13*b* may include a permanent magnet and is referred to as an outer rotor because it rotates around the stator 13*a*, without being limited thereto.

The controller 30 may control the general operation of the washing machine. The controller 30 may control the water supply valve 6 and the drainage pump 10 illustrated in FIG. 2, the input unit 21, a motor control system 40, and various other electronic/electric devices constituting the washing machine. The speed and/or position of the motor 13 may be controlled. Examples of the motor 13 may include a permanent magnet synchronous motor (PMSM) or a brushless DC electric motor (BLDC) motor, without being limited thereto.

Figure 3:
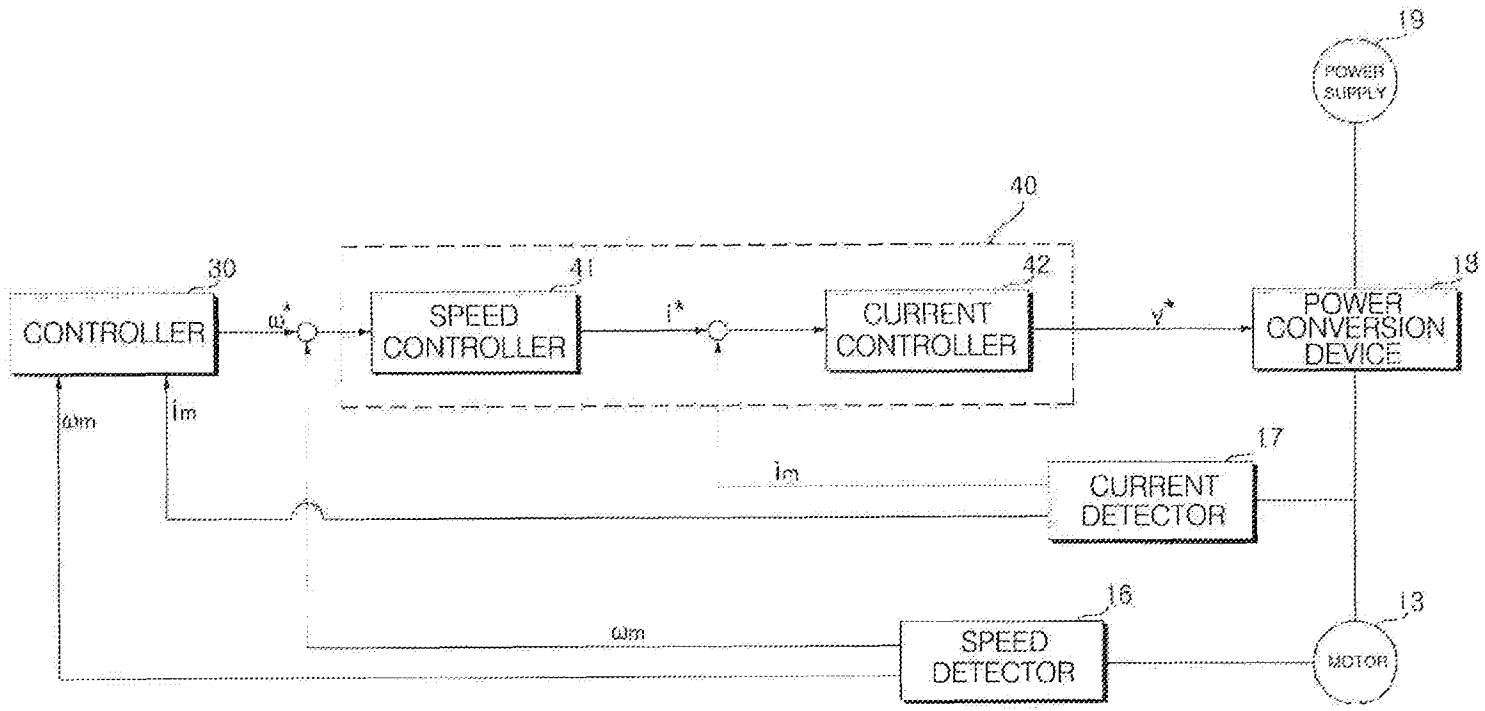
FIG. 3 is a block diagram illustrating the configuration of a motor drive system.
Figure 4:
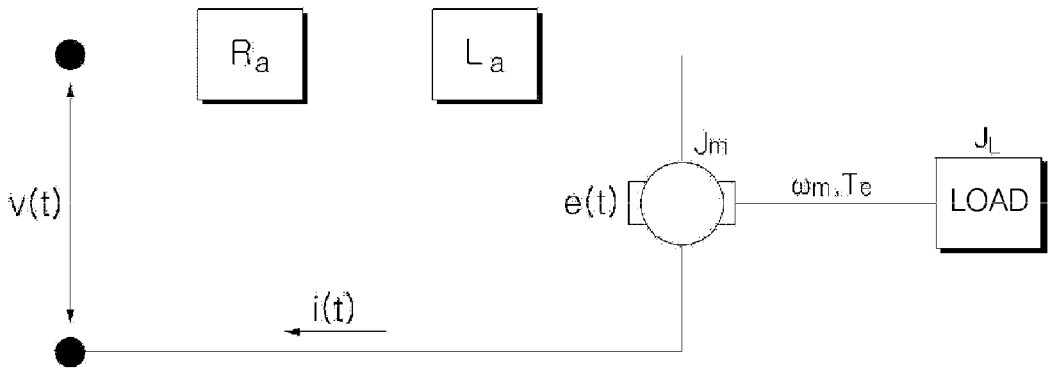
FIG. 4 is a block diagram illustrating an armature circuit which controls a motor.

Referring to FIGS. 3 and 4, the motor control system 40 may serve to control the rotation of the motor 13, and may include a speed controller 41 and a current controller 42. The speed controller 41 may output a current instruction i* based on a speed instruction ω* output from the controller 30. Because the control of torque is required in order to control the position or speed of the rotor 13*b* of the motor 13, and because the torque is proportional to current input to the armature 13*a*, the speed controller 41 may calculate the current i* required for the motor 13 to rotate at the speed ω*, and output the calculated current i* to the current controller 42.

A speed detector 16 may be provided to detect the speed of the rotor 13*b*, and the speed detected by the speed detector ($\omega_m$, hereinafter referred to as the "current speed") may be input to the speed controller 41. The speed controller 41 may adjust the instruction current value i* to be output, via proportional-integral (PI) control based on the instruction speed value ω*, which is input by the speed instruction output from the controller 30, and the current speed value $\omega_m$, thereby consequently enabling the generation of the torque required in order to set the current speed $\omega_m$ of the motor 13 to the instruction speed value ω*. Because the position θ of the rotor 13*b* is the integral value of the speed, the speed detector 16 may determine the position θ based on the detected current speed value $\omega_m$.

The current controller 42 may output a voltage instruction v* based on the current instruction i* output from the speed controller 41. In the embodiment, the control of the motor 13 may be based on the control of voltage applied to the motor 13 via a power conversion device 18. The instruction voltage value v* may be applied from the power conversion device 18 to the motor 13 based on the instruction voltage value v* output from the current controller 42, and in turn, the torque, which is generated by the motor 13 based on the instruction voltage value v*, may be substantially the same as that as in the case where the motor 13 is directly controlled based on the instruction current value i*.

The current controller 42 may adjust the instruction voltage value v* to be output, via PI control based on the instruction current value i*, which may be input by the speed instruction from the speed controller 41, and the current $i_m$ (hereinafter referred to as the "current current") detected by a current detector 17. The power conversion device 18 may convert the power output from a power supply 19 to apply the voltage v* to the motor 13. The power conversion device 18 may include a pulse width modulation (PWM) calculator, which may output a signal having the same magnitude as the instruction voltage value v* and a frequency pulse based on PWM, and an inverter, which may directly control the power input to the motor 13 upon receiving a PWM signal from the PWM calculator. In some embodiments, the PWM calculator may be included in the inverter, this kind of inverter typically being referred to as a PWM inverter.

Referring to FIG. 4, the following equations or relationship may emerge from the armature circuit which controls the motor 13.

Voltage Equation of Armature Circuit:

$$v(t) = L_a \frac{di(t)}{dt} + R_a i(t) + e(t) \quad \text{Equation (1)}$$

(here, v(t): voltage applied to armature circuit,
i(t): current of armature winding [A]
$R_a$: resistance of armature winding [Ω]
$L_a$: inductance of armature winding [H]
e(t): back electro-motive force (EMF) [V]).

Motion Equation of Load:

$$T_e = k_T \Phi_f i(t) = J \frac{d\omega_m}{dt} + B\omega_m + T_L \quad \text{Equation (2)}$$

$$J=J_m+J_L \quad \text{Equation (3)}$$

(here, $T_e$: torque generated by motor [Nm]
$k_T$: torque constant [Nm/Wb/A]
$\phi_f$: magnetic flux of field magnet
J: inertial moment of entire system [kg·m$^2$]
$\omega_m$: angular speed of rotor [rad/s]
$J_m$: inertial moment of rotor [kg·m$^2$]
$J_L$: inertial moment of load [kg·m$^2$]
B: viscous frictional coefficient [Nm/(rad/s)]).

In the motion equation of load, the inertial moment J of the entire system may be determined based on a current value, which may be detected during a fabric amount sensing operation in which the wash tub 3 is rotated at a constant acceleration $\alpha_1$ to a prescribed target speed $\omega_s$, and thereafter is rotated while maintaining the target speed $\omega_s$.

More specifically, the motion equation of load while the wash tub 3 is accelerated may be represented as follows:

$$k_T\Phi_f i_1=J\alpha_1+B\omega_1+T_L \quad \text{Equation (4)}$$

Here, $i_1$ and $\omega_1$ may be values detected respectively by the current detector 17 and the speed detector 16 at a specific point in time $t_1$ while the wash tub 3 is accelerated.

The motion equation of load while the wash tub 3 is rotated at the target speed $\omega_s$ may be represented as follows.

$$k_T\Phi_f i_2=O+B\omega_2+T_L \quad \text{Equation (5)}$$

Here, $i_2$ and $\omega_2$ may be values detected respectively by the current detector 17 and the speed detector 16 at a specific point in time $t_2$ while the wash tub 3 is rotated at the target speed $\omega_s$. Because $k_T$, $\phi_f$, and B can be previously known from values determined based on the specifications of the motor 13, $T_L$ may be determined from Equation (5), and the inertial moment J of the entire system may be determined by substituting $T_L$ to Equation (4). The inertial moment J of the entire system may vary based on the amount of fabric introduced into the wash tub 3. Hereinafter, the amount of fabric will be defined as "J" or a property value that varies according to "J".

Torque $T_L$ of load varies based on the state of dispersal of fabric inside the wash tub 3. Accordingly, the extent to which the wash tub 3 is unbalanced during rotation, i.e. "unbalance" may be defined based on the torque $T_L$ of load. Although the unbalance may be defined as the torque $T_L$ of load, the unbalance may be defined as a property value that varies according to the torque $T_L$ of load. For example, the unbalance UB may be defined as follows from the following Equation 2.

$$UB=\frac{B\omega_m+T_L}{\frac{d\omega_m}{dt}}-\frac{k_T\Phi_f i(t)}{\frac{d\omega_m}{dt}}-J \quad \text{Equation (6)}$$

In Equation 6, when $$\frac{k_T\Phi_f}{\frac{d\omega_m}{dt}}$$

is defined as UBconst, the unbalance UB may be defined as follows.

$$UB=UBconst\cdot i(t)-J \quad \text{Equation (7)}$$

In the case where the unbalance UB is determined while the wash tub 3 is rotated at a constant acceleration ($\alpha$, see FIG. 5), UBconst may have a constant value while the wash tub 3 is accelerated. Therefore, the unbalance UB may be determined based on the amount of fabric J determined as described above and the value of current applied to the motor 13 at a specific point in time when the unbalance UB is determined.

The value of current, used to determine the unbalance UB in Equation (7), may be a value detected by the current detector 17 when the rotational speed of the wash tub 3 reaches a predetermined target speed $\omega_{UB}$ while the wash tub 3 is rotated at a constant acceleration. Here, the target speed $\omega_{UB}$ may be the speed at which the vibration of the wash tub 3 is maximized, and may be determined through experimentation.

When the speed value detected by the speed detector 16 reaches the target speed $\omega_{UB}$ while the wash tub 3 is rotated at a constant acceleration, the controller 30 may determine the unbalance UB using the maximum of the current values detected by the current detector 17 during a prescribed time period. For example, the time period during which the maximum current value is determined may be a given time period including the point in time at which the rotational speed reaches the target speed $\omega_{UB}$, a given time period after the rotational speed has reached the target speed $\omega_{UB}$, or a given time period before the rotational speed reaches the target speed $\omega_{UB}$.

Figure 5:
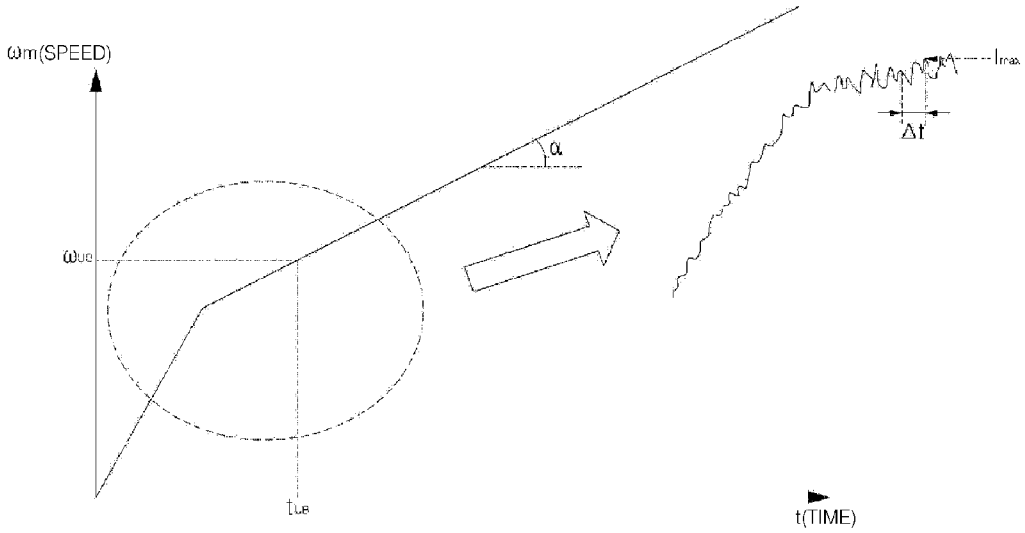
FIG. 5 is a graph illustrating a speed range in which unbalance is detected during rotation of a wash tub.

FIG. 5 is a graph illustrating variation in the speed of the wash tub 3 over time while the wash tub 3 is rotated at a constant acceleration $\alpha$. It may be appreciated that the current speed $\omega_m$ of the wash tub 3 varies to thus follow the instruction speed value $\omega^*$. In this case, the current value detected by the current detector 17 may also vary, and in particular, may vary greatly as vibration increases. The unbalance UB may be determined based on the current current value when the largest vibration is generated. In view thereof, the controller 30 may calculate the unbalance UB using the maximum of the varying current values. However, because the target speed $\omega_{UB}$ may be a value that is set in consideration of the speed at which the maximum vibration occurs, the controller 30 may calculate the unbalance UB using the current value detected by the current detector 17 at the point in time when the present speed $\omega_m$ detected by the speed detector reaches the target speed $\omega_{UB}$.

Meanwhile, in Equation (7), the unbalance UB may increase as the current value i(t) increases (vibration increases) and the amount of fabric J decreases. Generally, the case where the current value is large and the amount of fabric is small (i.e. the unbalance UB is large) may be the case where the volume of fabric introduced into the wash tub 3 is small, and thus the fabric is collected on one side inside the wash tub 3. An example may be the case where a sheet of bedding such as a thin bed sheet or one or two towels are introduced into the wash tub 3. Hereinafter, the state in which fabric is introduced into the wash tub 3 as described above is referred to as "the state of unbalance of a small amount of fabric".

Conversely, in the case where the current value is small and the amount of fabric is large, the unbalance UB may be small. Generally, this may be the case where a large volume of fabric such as, for example, a blanket, a thick sheet of bedding, or a winter quilt, is introduced into the wash tub 3. Hereinafter, the state in which fabric is introduced into the wash tub 3 as described above is referred to as "the state of balance of a large amount of fabric".

A control method of the washing machine in accordance with an embodiment may include supplying water into the wash tub 3 to a predetermined unbalance induction water level HO, rotating the pulsator 4, sensing the amount of fabric J, rotating the wash tub 3 at a constant acceleration α, determining unbalance UB based on the amount of fabric J and the current value $i_m$ applied to the motor 13 in the state in which the speed $\omega_m$ falls within a given range while the wash tub 3 is rotated at the acceleration α, and supplying water into the wash tub 3 to a first water supply level WL1 when the unbalance UB is greater than a reference value UBO, or supplying water into the wash tub 3 to a second water supply level WL2 when the unbalance UB is smaller than the reference value UBO.

The control method described above may judge the state of unbalance of a small amount of fabric or the state of balance of a large amount of fabric based on the unbalance UB, and may optimize the level of water supplied for washing or rinsing based on the respective states. Hereinafter, the control method will be described in more detail with reference to FIGS. 6 and 7.

Figure 6:
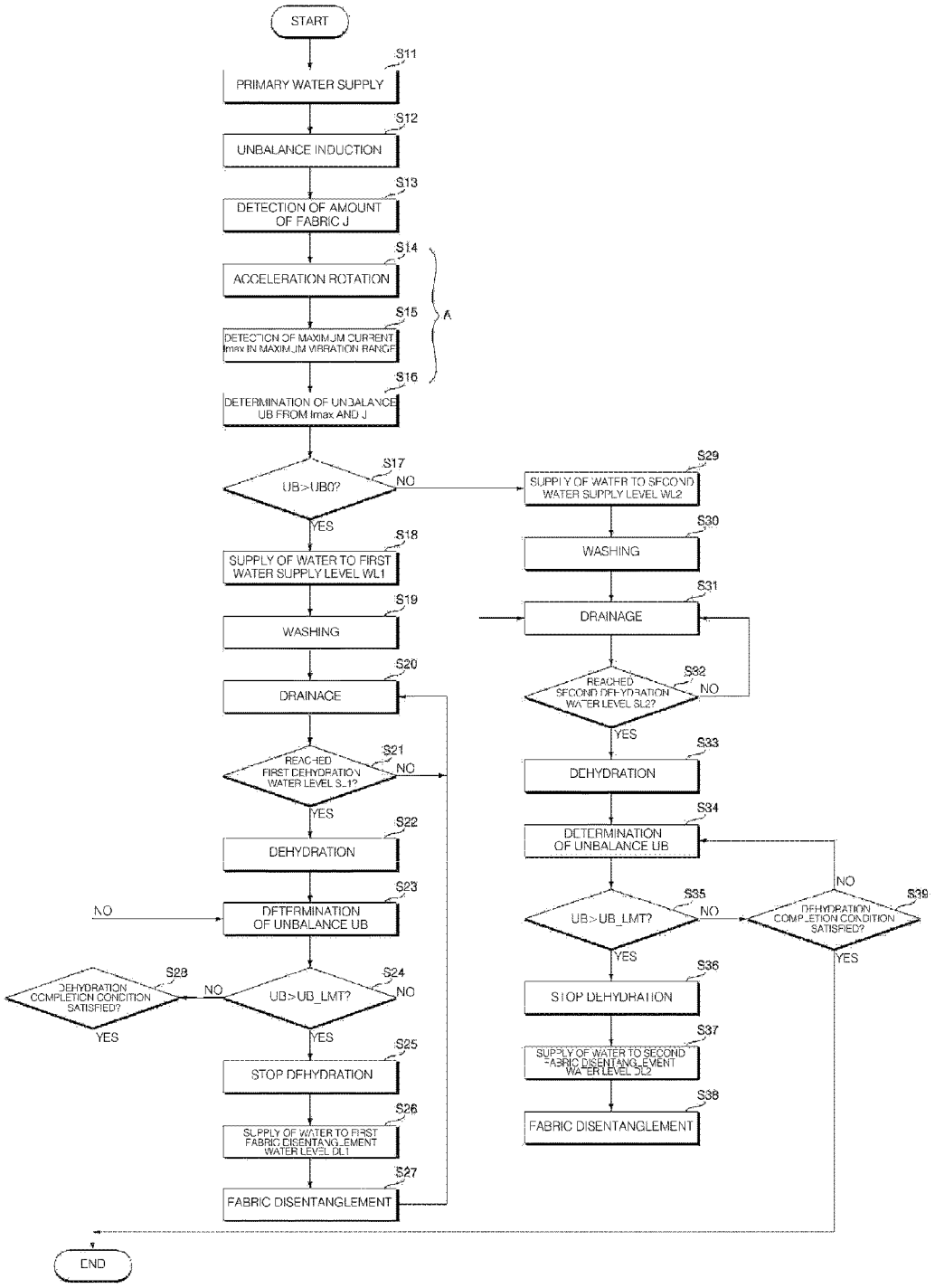
FIG. 6 is a flowchart referenced to explain a control method of a washing machine in accordance with one embodiment.
Figure 7:
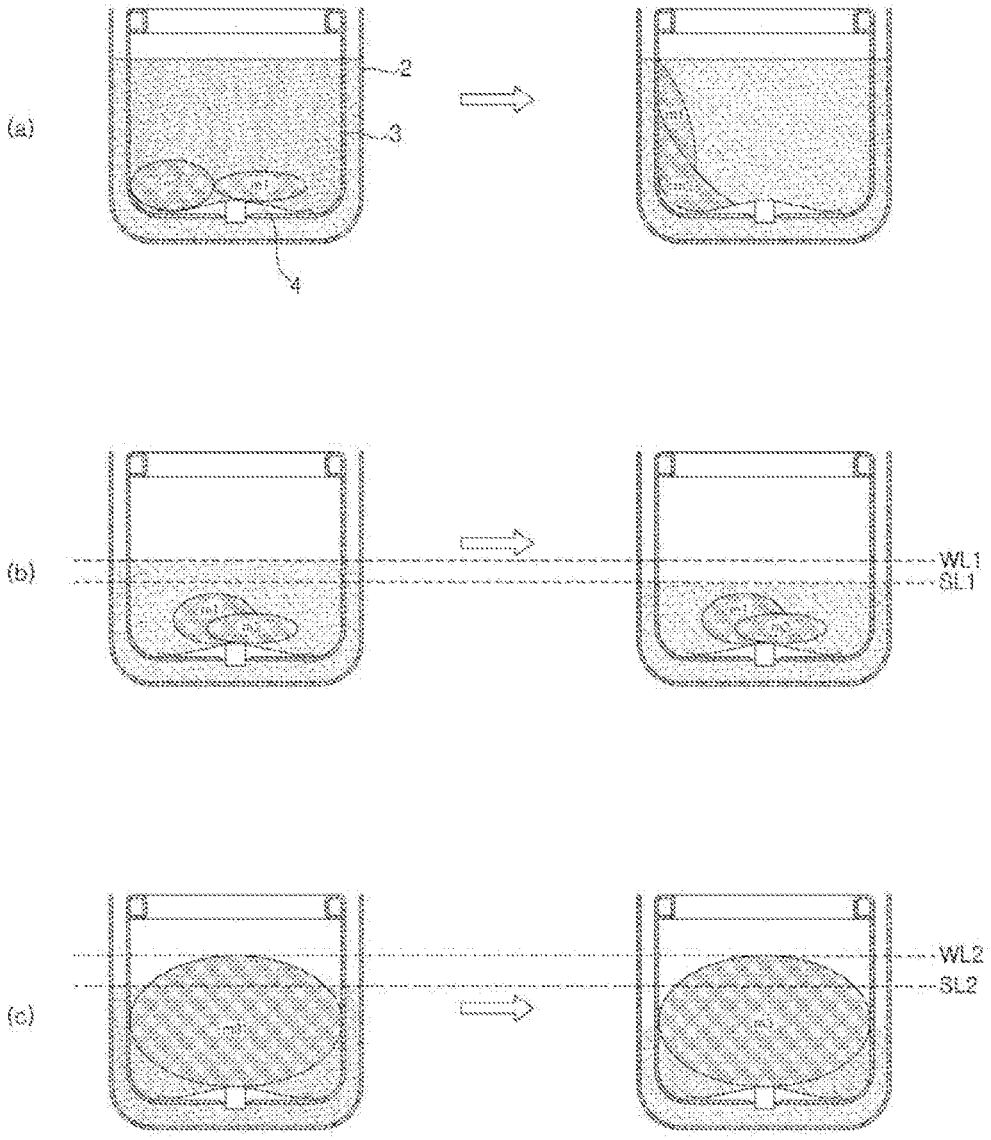
FIG. 7 illustrates a drainage operation in a washing machine (a), washing and drainage operations S18 to S20 (*b*) upon judging that unbalance is greater than a reference value in operation S17 of FIG. 6, and washing and drainage operations S29 to S31 (*c*) upon judging that unbalance is smaller than a reference value in operation S17 of FIG. 6.

FIG. 6 is a flowchart referenced to explain the control method of the washing machine in accordance with an embodiment. FIG. 7(*a*) is a view illustrating a drainage operation in a washing machine, FIG. 7(*b*) is a view illustrating washing and drainage operations S18 to S20 upon judging that the unbalance is greater than a reference value in operation S17 of FIG. 6, and FIG. 7(*c*) is a view illustrating washing and drainage operations S29 to S31 upon judging that the unbalance is smaller than the reference value in operation S17 of FIG. 6.

In the state in which fabric is introduced into the wash tub 3, water may be supplied to the predetermined unbalance introduction water level (HO, see FIG. 1) in the water storage tub 2 or the wash tub 3 (S11). The washing machine may include a water level sensor 23, which senses the level of water inside the water storage tub 2, and after the water supply valve 5 is opened, the controller 30 may close the water supply valve 5 upon judging that the level of water sensed by the water level sensor 23 has reached the unbalance induction water level HO.

Although the unbalance induction water level HO may be set to a level of water at which at least a portion of fabric placed over the pulsator 4 may be damp, in the case where a small amount of fabric, such as a thin sheet or one or two towels, is introduced, the unbalance induction water level HO may be set to a sufficiently low level of water at which the fabric continuously remains in contact with the pulsator 4 even if it is moved by a water stream generated during the rotation of the pulsator 4, but the pulsator 4 is completely submerged in the water. When levels to which water may be supplied are predetermined, the unbalance induction water level HO may be set to the lowest water level among the predetermined water levels. For example, in the case of a washing machine in which water may be supplied in ten stages from a first water level (the lowest water level) to a tenth water level (the highest water level), the unbalance induction water level HO may be set to the first water level.

In the state in which the water storage tub 2 is filled with water via the first water supply operation S11, an unbalance induction operation S12 may be performed. In the unbalance induction operation S12, the pulsator 4 may be alternately rotated in opposite directions. At the unbalance induction water level HO, the fabric may be moved by coming into contact with the pulsator 4. In the state of unbalance of a small amount of fabric, the fabric may be easily collected on one side inside the wash tub 3 after the unbalance induction operation S12 is completed.

Conversely, in the state of balance of a large amount of fabric, the extent to which unbalance is induced may be lower than that in the state of unbalance of a small amount of fabric because variation in the position of fabric may be small despite the rotation of the pulsator 4 and the interior of the wash tub 3 has previously been filled with a larger volume of fabric than in the state of unbalance of a small amount of fabric.

Through the unbalance induction operation S12, the extent to which fabric is collected on one side inside the wash tub 3 differs between the state of unbalance of a small amount of fabric and the state of balance of a large amount of fabric. Therefore, when the unbalance is sensed after the unbalance induction operation S12, the state of unbalance of a small amount of fabric and the state of balance of a large amount of fabric may be clearly and accurately discriminated based on the sensed unbalance.

Thereafter, a fabric amount sensing operation S13 may be performed. The fabric amount sensing operation S13 may include accelerating the wash tub 3 to a predetermined target speed $\omega_s$, and rotating the wash tub 13 while maintaining the target speed $\omega_s$ for a prescribed time period. In the fabric amount sensing operation S13, the amount of fabric J may be determined by the above-described method with reference to Equation (4) and Equation (5).

Thereafter, an unbalance calculation operation A for calculating unbalance UB may be performed. The unbalance calculation operation A may include rotating the wash tub 3 at a constant acceleration α (S14), detecting current applied to the motor 13 in the state in which the rotational speed of the wash tub 3 falls within a given range while the wash tub 3 is accelerated, and calculating unbalance UB based on the amount of fabric J determined in operation S13 and the current value determined in operation S14.

The current required to calculate the unbalance UB may be current value $i_m$ detected by the current detector 17 at the point in time $t_{UB}$ at which the speed $\omega_m$ detected by the speed detector 16 reaches an unbalance sensing speed $\omega_{UB}$. In another example, the current required to calculate the unbalance UB may be a current value detected by the current detector 17 in a given speed range near the unbalance sensing speed $\omega_{UB}$. In this case, the speed range may correspond to a given time period Δt after the speed $\omega_m$ detected by the speed detector 16 has reached the unbalance sensing speed $\omega_{UB}$, a given time period Δt including the point in time at which the speed $\omega_m$ has reached the unbalance sensing speed $\omega_{UB}$, or a given time period Δt before the speed $\omega_m$ reaches the unbalance sensing speed $\omega_{UB}$. The maximum of current values determined from speeds near the unbalance sensing speed $\omega_{UB}$ may be used to calculate the unbalance UB.

In operation S16, the unbalance UB may be determined based on the amount of fabric J determined in the fabric amount sensing operation S13 and the current value (e.g. $I_{max}$) determined while the wash tub 3 is accelerated. At this time, the unbalance UB may be determined as described above with reference to Equation (2), Equation (6) and Equation (7).

In operation S17, the controller 30 may compare the unbalance UB with a predetermined reference value UBO. Thereafter, the controller 30 may open the water supply valve 5 to supply water for a subsequent washing operation S19 or rinsing operation. Upon judging that the unbalance UB is greater than the reference value UBO in operation S17 (i.e. in the state of unbalance of a small amount of fabric), water may be supplied to the first water supply level WL1 into the wash tub 3 (S18). Conversely, upon judging that the unbalance UB is smaller than the reference value UBO in operation S17 (i.e. in the state of balance of a large amount of fabric), water may be supplied to the second water supply level WL2, which may be higher than the first water supply level WL1, into the wash tub 3 (S29).

The reason why the state of unbalance of a small amount of fabric and the state of balance of a large amount of fabric are discriminated from each other and the water levels are differentiated based on the respective states is to prevent fabric from being collected on one side inside the wash tub 3 in a drainage operation S20 or S31, which may be performed after the washing operation S19 or rinsing operation is completed and before a dehydration operation S22 or S33 begins.

More specifically, FIG. 7(*a*) illustrates the movement of fabric when washing is performed in the state in which a sufficiently greater amount of water than the first water supply level WL1 is stored in the wash tub 3 in the state of unbalance of a small amount of fabric. As illustrated in FIG. 7(*a*), pieces of fabric m1 and m2, which have small volumes, may be moved by buoyancy and a water stream, and may be easily collected on one side inside the wash tub 3.

On the other hand, FIG. 7(*b*) illustrates the case where water is supplied to the first water supply level WL1 in the state of unbalance of a small amount of fabric (S18), and the washing operation S19 and the drainage operation S20 may be performed in sequence. In this case, because washing is implemented at a low water level, the two pieces of fabric m1 and m2 partially overlap each other and may be placed over the pulsator 4 during washing. Even if the drainage operation S20 is implemented after the washing operation S19 is completed, the pieces of fabric m1 and m2 may not be collected on one side and remain on the bottom of the wash tub 3, i.e. over the pulsator 4.

The controller 30 may control the wash tub 3 so as to be rotated at a predetermined drainage rotational speed during the drainage operation S20. Rotating the wash tub 3 during the drainage operation 20 may serve to efficiently discharge water, and the drainage rotational speed may be a speed lower than that in the dehydration operation S22, for example, a speed of 30 RPM or less.

When the water level sensed by the water level sensor 23 during the drainage operation S20 has reached a first dehydration water level SL1, the controller 30 may rotate the wash tub 3 at a high speed so as to perform the dehydration operation S22. The pieces of fabric m1 and m2 are adhered to the inner surface of the wash tub 3 by centrifugal force caused by the rotation of the wash tub 3. As described above, the pieces of fabric m1 and m2 may be evenly distributed during the dehydration operation S22 because the pieces of fabric m1 and m2 are placed on the bottom of the wash tub 3 during the drainage operation S20. The unbalance may be sensed during dehydration (S23). In operation S23, the unbalance may be sensed while the wash tub 3 is rotated at a given speed, and may be calculated from the above-described Equation 6.

In operation S24, the unbalance UB calculated in operation S23 may be compared with a predetermined tolerance value UB_LMT. When the comparison result is that the unbalance UB is greater than the tolerance value UB_LMT, in order to prevent the occurrence of excessive vibration, the dehydration may stop (S25), and water may be again supplied up to a first fabric disentanglement water level DL1 in the wash tub 3 (S26). Thereafter, at least one of the wash tub 3 and the pulsator 4 may be rotated to perform a fabric disentanglement operation S27 for varying the position of the fabric inside the wash tub 3. After the fabric disentanglement operation S27 has been performed for a prescribed time period, the control method may return to operation S20.

Upon judging that the unbalance UB calculated in operation S23 is lower than the tolerance value UB_LMT, the dehydration may be continued, and may end when a predetermined dehydration completion condition is satisfied ("Yes" in operation S28). For example, the dehydration may end when the time period during which the dehydration operation S22 is performed reaches a predetermined time period.

FIG. 7(*c*) illustrates the case where water is supplied to the second water supply level WL2 in the state of balance of a large amount of fabric (S29), and the washing operation S30 and the drainage operation S31 are performed in sequence. In this case, because the water level, at which washing is performed, is higher than that in the state of unbalance of a small amount of fabric (WL2>WL1), and the volume of fabric m3 is large, the phenomenon in which the fabric is moved and collected on one side may not readily occur even if the water level is high. Therefore, variation in the position of the fabric m3 may be small even if the drainage operation S31 is performed after the washing operation S30 is completed.

The controller 30 may control the wash tub 3 to rotate at a predetermined drainage rotational speed during the drainage operation S31. The wash tub 3 may be rotated during the drainage operation S31 so as to ensure smooth drainage in the same manner as in operation S20.

When the water level sensed by the water level sensor 23 reaches a second dehydration water level SL2 during the drainage operation S31, the controller 30 may rotate the wash tub 3 at a high speed so as to perform a dehydration operation S33. The wash tub 3 may be controlled so as to be rotated at a predetermined drainage rotational speed. The second dehydration water level SL2 may be set higher than the first dehydration water level SL1. The unbalance may be sensed during the dehydration (S34). The unbalance may be sensed while the wash tub 3 is rotated at a constant speed in the same manner as in operation S23.

In operation S35, the unbalance UB calculated in operation S24 is compared with the predetermined tolerance value UB_LMT. When the comparison result is that the unbalance UB is greater than the tolerance value UB_LMT, in order to prevent the occurrence of excessive vibration, the dehydration stops (S36), and water is again supplied up to a second fabric disentanglement water level DL2 in the wash tub 3 (S37). The second fabric disentanglement water level DL2 may be higher than the first fabric disentanglement water level DL1.

Thereafter, in the same manner as in operation S27, at least one of the wash tub 3 and the pulsator 4 may be rotated to perform a fabric disentanglement operation S38 for varying the position of fabric inside the wash tub 3. After the fabric disentanglement operation S38 has been performed for a prescribed time period, the control method may return to operation S31.

Meanwhile, upon judging that the unbalance UB determined in operation S34 is lower than the tolerance value UB_LMT, the dehydration may be continued, and may then be completed when a predetermined dehydration completion condition is satisfied ("Yes" in operation S39). For example, the dehydration may end when the time period during which the dehydration operation S33 is performed reaches a predetermined time period.

The state of fabric introduced into a wash tub may be categorized into one of two cases based on a characteristic of the fabric, so that water may be supplied to a predetermined level appropriate for the respective cases. This may optimize the arrangement of fabric inside the wash tub. The fabric may be evenly dispersed inside the wash tub before dehydration. As fabric is evenly dispersed inside a wash tub during dehydration, it may be possible to restrict the occurrence of vibration during dehydration and to prevent unwanted stop of dehydration attributable to excessive vibration.

In accordance with an embodiment, the above and other objects can be accomplished by the provision of a control method of a washing machine, the washing machine including a water storage tub, a wash tub configured to accommodate fabric, the wash tub being rotated about a vertical axis inside the water storage tub, a pulsator rotatably provided inside the wash tub, and a motor configured to rotate at least one of the wash tub and the pulsator, the control method including supplying water to a predetermined unbalance induction water level into the wash tub, rotating the pulsator, sensing an amount of fabric, rotating the wash tub at a constant acceleration, determining unbalance based on a current value applied to the motor in a state in which a rotational speed of the wash tub falls in a given range and the sensed amount of fabric while the wash tub is rotated at the constant acceleration, and supplying water to a first water supply level into the wash tub when the unbalance is greater than a reference value, and supplying water to a second water supply level, which is higher than the first water supply level, when the unbalance is smaller than the reference value.

In the supplying, the unbalance induction water level may be equal to or higher than a water level at which the pulsator is completely submerged. The unbalance induction water level may be a lowest water level among water levels, to which water is supplied via control of a water supply valve configured to supply water into the wash tub. In the rotating the pulsator, the pulsator may be alternately rotated in opposite directions.

The sensing may include accelerating the wash tub to a predetermined target speed, and rotating the wash tub at the predetermined target speed during a given time period, and the amount of fabric may be determined based on a difference between a current value applied to the motor in the accelerating the wash tub to the predetermined target speed and a current value input to the motor in the rotating the wash tub at the predetermined target speed. In the determining, the unbalance may be determined based on a maximum of current values applied to the motor during a prescribed time period.

The control method may further include processing the fabric by rotating at least one of the wash tub and the pulsator, after the supplying the water to the first water supply level or the second water supply level, draining the water from the water storage tub, and dehydrating the fabric by rotating the wash tub at a high speed, and the dehydrating may be performed when a level of water inside the wash tub is lowered to a first dehydration water level via the draining when the water has been supplied to the first water supply level, and the dehydrating may be performed when a level of water level inside the wash tub is lowered to a second dehydration water level, which is higher than the first dehydration water level, when the water has been supplied to the second water supply level.

The control method may further include sensing the unbalance during the dehydrating, and stopping the dehydrating when the sensed unbalance is equal to or greater than a tolerance value. The control method may further include again supplying water into the wash tub after the stopping, and varying a position of the fabric inside the wash tub by rotating at least one of the pulsator and the wash tub, and the stopping may include supplying water to a first fabric disentanglement water level when the water has been supplied to the first water supply level in the supplying water to the first water supply level, and supplying water to a second fabric disentanglement water level, which is higher than the first fabric disentanglement water level, when the water has been supplied to the second water supply level in the supplying water to the second water supply level.

A control method of a washing machine, the washing machine including a water storage tub, a wash tub configured to accommodate fabric, the wash tub being rotated about a vertical axis inside the water storage tub, a pulsator rotatably provided inside the wash tub, and a motor configured to rotate at least one of the wash tub and the pulsator, may include rotating the pulsator in a state in which a prescribed amount of water is accommodated in the wash tub to allow at least a part of fabric to be wet, accelerating the motor to a target speed and then rotating the motor while maintaining the target speed during a given time period, and determining an inertial moment from a following load equation based on a current value applied to the motor while the motor is accelerated to the target speed and a current value applied to the motor while the motor is rotated while maintaining the target speed, determining unbalance, which varies according to a $T_L$ value of the following load equation, based on a current value applied to the motor while the motor is accelerated at a constant acceleration and the inertial moment, and supplying water to a first water supply level into the wash tub when the unbalance is greater than a reference value, and supplying water to a second water supply level, which is higher than the first water supply level, when the unbalance is smaller than the reference value, and the load equation may be represented by $$T_e = k_T \Phi_f i(t) = J\frac{d\omega_m}{dt} + B\omega_m + T_L$$

(wherein, J is the sum of an inertial moment of a rotor of the motor and an inertial moment of load, i(t) is instantaneous current applied to the motor, $T_e$ is a torque generated by the motor, $K_T$ is a torque constant of the motor, $\phi_f$ is a magnetic flux of a field magnet of the motor, $\omega_m$ is an angular speed of the rotor of the motor, and B is a viscous frictional coefficient).

In the rotating, a level of water inside the wash tub may be equal to or greater than a water level at which the pulsator is completely submerged. The rotating may be performed in a state in which the water has been supplied into the wash tub to a lowest water level among water levels, to which the water is supplied into the wash tub via control of a water supply valve configured to supply water into the wash tub. In the rotating, the pulsator may be alternately rotated in opposite directions.

The control method may further include processing the fabric by rotating at least one of the wash tub and the pulsator, after the supplying the water to the first water supply level or the second water supply level, draining the water from the water storage tub, and dehydrating the fabric by rotating the wash tub at a high speed, and the dehydrating may be performed when a level of water inside the wash tub is lowered to a first dehydration water level via the draining when the water has been supplied to the first water supply level, and the dehydrating may be performed when a level of water level inside the wash tub is lowered to a second dehydration water level, which is higher than the first dehydration water level, when the water has been supplied to the second water supply level.

The control method may further include sensing the unbalance during the dehydrating, and stopping the dehydrating when the sensed unbalance is equal to or greater than a tolerance value.

The control method may further include again supplying water into the wash tub after the stopping, and varying a position of the fabric inside the wash tub by rotating at least one of the pulsator and the wash tub, and the stopping may include supplying water to a first fabric disentanglement water level when the water has been supplied to the first water supply level in the supplying water to the first water supply level, and supplying water to a second fabric disentanglement water level, which is higher than the first fabric disentanglement water level, when the water has been supplied to the second water supply level in the supplying water to the second water supply level.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A control method of a washing machine, the washing machine including a water storage tub, a wash tub configured to accommodate fabric, the wash tub being rotated about a vertical axis inside the water storage tub, a pulsator rotatably provided inside the wash tub, and a motor configured to rotate at least one of the wash tub and the pulsator, the control method comprising:

supplying water to a predetermined water level in the wash tub;

rotating the pulsator alternately in opposite directions while the wash tub is filled to the predetermined water level, wherein at the predetermined water level, the fabric continuously remains in contact with the pulsator during the rotation of the pulsator;

sensing an amount of fabric;

rotating the wash tub at a constant acceleration after the fabric is moved while in contact with the pulsator as the pulsator rotates alternately in opposite directions;

sensing a current value applied to the motor when a rotational speed of the wash tub is within a given range while the wash tub is rotated at the constant acceleration;

determining unbalance based on the sensed amount of fabric and the current value applied to the motor; and supplying water to a predetermined water supply level which is determined based on the unbalance, wherein the predetermined water supply level is determined as a first water supply level when the unbalance is greater than a reference value, and wherein the predetermined water supply level is determined as a second water supply level higher than the first water supply level when the unbalance is smaller than the reference value.

2. The control method according to claim 1, wherein during the supplying, the predetermined water level is equal to or higher than a water level at which the pulsator is completely submerged.

3. The control method according to claim 2, wherein the predetermined water level is a lowest water level among a plurality of water levels, to which water is supplied via control of a water supply valve configured to supply water into the wash tub.

4. The control method according to claim 1, wherein the sensing includes:

accelerating the wash tub to a predetermined target speed; and rotating the wash tub at the predetermined target speed during a given time period, wherein the amount of fabric is determined based on a difference between a current value applied to the motor in the accelerating the wash tub to the predetermined target speed and a current value input to the motor during the rotating of the wash tub at the predetermined target speed.

5. The control method according to claim 1, wherein during the determining, the unbalance is determined based on a maximum of current values applied to the motor during a prescribed time period.

6. The control method according to claim 1, further including:

processing the fabric by rotating at least one of the wash tub and the pulsator after the supplying of the water to the first water supply level or the second water supply level;

draining the water from the water storage tub; and dehydrating the fabric by rotating the wash tub at a high speed, wherein when the water has been supplied to the first water supply level, the dehydrating is performed when a level of water inside the wash tub is lowered to a first dehydration water level via the draining, and wherein when the water has been supplied to the second water supply level, the dehydrating is performed when a level of water level inside the wash tub is lowered to a second dehydration water level, which is higher than the first dehydration water level.

7. The control method according to claim 6, further including:

sensing the unbalance during the dehydrating; and stopping the dehydrating when the sensed unbalance is equal to or greater than a tolerance value.

8. The control method according to claim 7, further including:

resupplying water into the wash tub after the stopping; and varying a position of the fabric inside the wash tub by rotating at least one of the pulsator and the wash tub, wherein the stopping includes supplying water to a first fabric disentanglement water level when the water has been supplied to the first water supply level, and supplying water to a second fabric disentanglement water level higher than the first fabric disentanglement water level, when the water has been supplied to the second water supply level.

9. A control method of a washing machine, the washing machine including a water storage tub, a wash tub configured to accommodate fabric, the wash tub being rotated about a vertical axis inside the water storage tub, a pulsator rotatably provided inside the wash tub, and a motor configured to rotate at least one of the wash tub and the pulsator, the control method comprising:

rotating the pulsator alternately in opposite directions while the wash tub is filled to a predetermined water level, wherein at the unbalance induction water, the fabric continuously remains in contact with the pulsator during the rotation of the pulsator;

accelerating the motor to a target speed and then rotating the motor while maintaining the target speed during a given time period, and determining an inertial moment from a load equation based on a current value applied to the motor while the motor is accelerated to the target speed and a current value applied to the motor while the motor is rotated while maintaining the target speed;

determining unbalance, which varies according to a $T_L$ value of the load equation, based on a current value applied to the motor while the motor is accelerated at a constant acceleration and the inertial moment; and supplying water to a first water supply level in the wash tub when the unbalance is greater than a reference value, and supplying water to a second water supply level higher than the first water supply level when the unbalance is smaller than the reference value, wherein the load equation is represented by $$T_e - k_T \Phi_f i(t) - J\frac{d\omega_m}{dt} + B\omega_m + T_L,$$

wherein J is the sum of an inertial moment of a rotor of the motor and an inertial moment of load, i(t) is instantaneous current applied to the motor, $T_e$ is a torque generated by the motor, $K_T$ is a torque constant of the motor, $\Phi_f$ is a magnetic flux of a field magnet of the motor, $\omega_m$ is an angular speed of the rotor of the motor, and B is a viscous frictional coefficient.

10. The control method according to claim 9, wherein during the rotating, a level of water inside the wash tub is equal to or greater than a water level at which the pulsator is completely submerged.

11. The control method according to claim 9, wherein the rotating is performed in a state in which the water has been supplied into the wash tub to a lowest water level among a plurality of water levels, to which the water is supplied into the wash tub via control of a water supply valve configured to supply water into the wash tub.

12. The control method according to claim 9, wherein during the rotating, the pulsator is alternately rotated in opposite directions.

13. The control method according to claim 9, further including:

processing the fabric by rotating at least one of the wash tub and the pulsator after the supplying the water to the first water supply level or the second water supply level;

draining the water from the water storage tub; and dehydrating the fabric by rotating the wash tub at a high speed, wherein the dehydrating is performed when a level of water inside the wash tub is lowered to a first dehydration water level via the draining when the water has been supplied to the first water supply level, and wherein the dehydrating is performed when a level of water level inside the wash tub is lowered to a second dehydration water level higher than the first dehydration water level when the water has been supplied to the second water supply level.

14. The control method according to claim 13, further including:

sensing the unbalance during the dehydrating; and stopping the dehydrating when the sensed unbalance is equal to or greater than a tolerance value.

15. The control method according to claim 14, further including:

resupplying water into the wash tub after the stopping; and varying a position of the fabric inside the wash tub by rotating at least one of the pulsator and the wash tub, wherein the stopping includes supplying water to a first fabric disentanglement water level when the water has been supplied to the first water supply level, and supplying water to a second fabric disentanglement water level higher than the first fabric disentanglement water level when the water has been supplied to the second water supply level.

* * * * *